US005819492A

United States Patent [19]

Konicek

[11] Patent Number: 5,819,492

[45] Date of Patent: Oct. 13, 1998

[54] COLLAPSIBLE ROOF TRUSS UTILIZING AN OPPOSED FLANGE ROOF HINGE

[76] Inventor: Richard R. Konicek, 3249 NW. 86th St., Apt. 623, Des Moines, Iowa 50322

[21] Appl. No.: 503,098

[22] Filed: Jul. 17, 1995

[51] Int. Cl.[6] ..... E04B 1/343; E04B 1/38; E04C 3/02

[52] U.S. Cl. ..... 52/641; 52/645; 52/646; 52/71; 403/119

[58] Field of Search ..... 52/79.5, 641, 645, 52/646, 655.1, 713, 71; 403/161–163, 119, 13, 14

[56] References Cited

U.S. PATENT DOCUMENTS

| | | | |
|---|---|---|---|
| Re. 31,234 | 5/1983 | Jureit et al. | 52/641 X |
| 1,232,168 | 7/1917 | Aronson | 52/641 |
| 2,524,652 | 10/1950 | Dalley | 403/161 |
| 3,449,997 | 6/1969 | Couch | 52/713 X |
| 3,479,783 | 11/1969 | Jureit | 52/641 X |
| 3,485,346 | 12/1969 | Ballard | 52/641 X |
| 3,605,355 | 9/1971 | Solesbee | 52/641 X |
| 3,729,877 | 5/1973 | Hall . | |
| 3,760,550 | 9/1973 | Mueller et al. . | |
| 3,785,108 | 1/1974 | Satchell | 52/641 X |
| 4,078,276 | 3/1978 | Nunes | 403/161 X |
| 4,538,393 | 9/1985 | Mitchell . | |
| 4,771,585 | 9/1988 | Ononda . | |
| 5,094,059 | 3/1992 | Ganescu | 52/79.5 X |
| 5,163,262 | 11/1992 | Adams . | |
| 5,228,258 | 7/1993 | Onoda et al. . | |

*Primary Examiner*—Robert Canfield

[57] ABSTRACT

The present invention is a collapsible roof truss comprising two elongated wooden structural members consisting of upper and lower chords, the lower chord having a bevel end, the angle of which corresponds to the roof pitch. The hinging mechanism comprises two identical metal disks, each having a rigid annulus at its respective periphery and with an opening in the center therethrough to pivotally connect the disks. Each chord has grooves formed on both sides, the depth of the grooves being equal to the height of the annuli, the grooves on the upper chord being in the form of a semi-circle, the grooves on the lower chord being in the form of an arc corresponding to the angle formed by the bevel, and each chord having a notch therethrough at the center of the radii of the semi-circle and the arc respectively for receiving a fastener therethrough. The grooves, when chords are in assembled relation, form a nearly complete circle. A first disk is placed on one side of the assembled structural members so that its annulus is positioned in the grooves having corresponding radii. The second disk is similarly positioned on the opposite side of the assembled structural members. A fastener, such as a bolt, is passed through the respective openings in the disks and the notches, a nut applied thereby drawing the annuli securely into the grooves wherein rotative hinging occurs. At the job site, the roof component is elevated to its desired pitch.

1 Claim, 3 Drawing Sheets

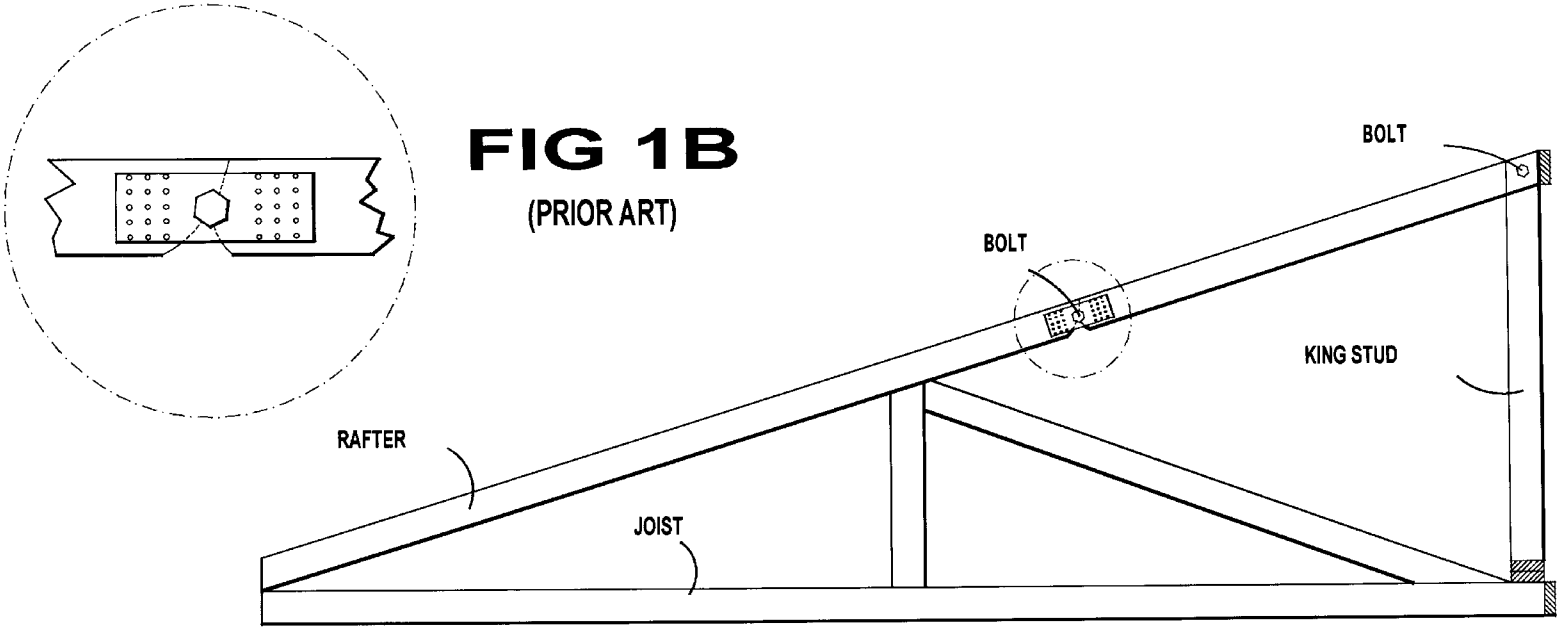
FIG 1A
(PRIOR ART)
FIG 1B
(PRIOR ART)
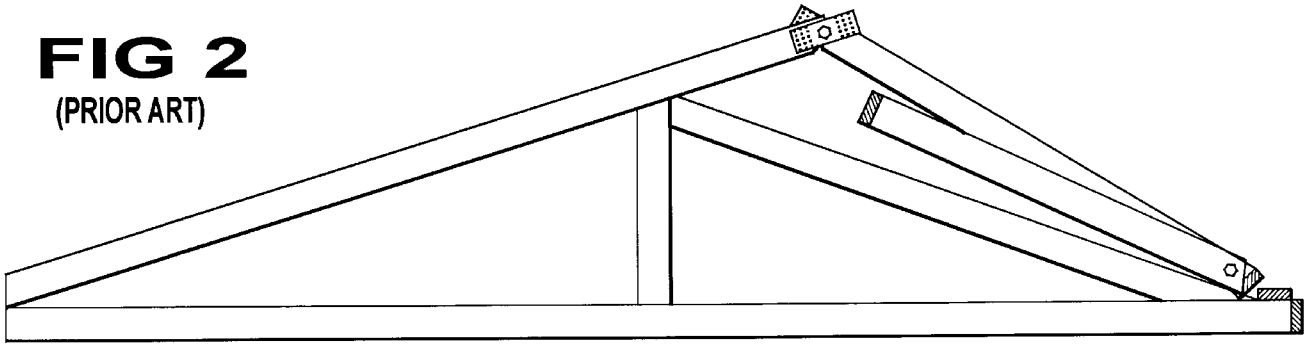
FIG 2
(PRIOR ART)

COLLAPSIBLE ROOF TRUSS UTILIZING AN OPPOSED FLANGE ROOF HINGE

BACKGROUND OF THE INVENTION

1. Field of the Invention

The present invention relates to a collapsible roof truss. More particular, the present invention relates to a collapsible roof truss comprised of two hinged elongated wooden structural members comprising an upper chord and a lower chord and two opposite facing metal disks each with rigid annulus formed at the respective periphery and each disk, having an opening at its respective center, the disks being connected to each other by means of a bolt passed through the respective openings in registry with one another, the disks being installed pivotally and secured within precut circular grooves at the distal ends of an upper chord and a corresponding lower chord allowing the roof to lay in a flat position to facilitate transportation.

2. Description of the Prior Art

The building of roof trusses on a building site in residential and in small commercial buildings is an expensive and time consuming process. In addition, where there are multiple trusses to be built, they are never perfectly uniform. As a result, the building industry has gravitated toward the use of prefabricated roof trusses which eliminates the costly on-site labor time. However, an obvious problem exists in which the transportation of prefabricated roof trusses is bulky, costly and requires a specialized truck. Therefore there exists a need in the building industry forcompactible roof trusses which overcomes the present disadvantages.

Buyer acceptance of modular (factory-built) homes has been limited by design constraints imposed by limitations of highway width and height restrictions. Width restrictions may vary by state, typically they are in the range of 14 feet to 18 feet. Interstate height restrictions are more uniform being a maximum of 13 feet 6 inches. Highway height limits impose the most severe design limitations on modular homes. The definition of a modular home are those homes built in two or more sections and mated on the job site whereas panelized homes are pre-constructed with fabricated wall panels and other components. Panelized homes in contrast to modular homes are less severely constrained by road dimensional limits because panel dimensions can more easily be varied to conform to road limits.

Despite steady sales growth of modular homes, the characteristic low roof pitch and low interior ceiling height have limited widespread consumer acceptance.

A conventional 4 foot by 12 foot pitch on a 14 foot wide modular roof typically adds 4 feet eight inches in height above the lower chords of a home at its peak. The height of a complete housing module including the floor framing, the interior ceiling height and an extended 4 foot by 12 foot roof component on a 14 foot wide module will have a total vertical dimension of 14 and one half feet. In addition, the added height of the transportation trailer must be accounted for when calculating the overall height for transportation height restrictions.

The modular housing industry's solution heretofore has been twofold: (1) to reduce the height of the ceiling to 7 feet and 6 inches and (2) to hinge the roof component in the roof line. The latter solution employes a slightly modified, conventional, triangular truss design whereby the top chord is hinged at some point in the roof line, most commonly the mid-point of the roof for the entire length of the home module.

The disadvantages of the previously described folding roof systems are: (1) the overall module height still remains excessive and requires a roof pitch of 3½ -in-12 or less; (2) the interior ceiling height remains at 7 feet 6 inches or less; (3) [the break in] the top chord member, compromises the structural integrity of the roof framing making it inherently weaker than a conventional truss; and (4) the break in the roof at the pivotal point can result in water intrusion during driving rain storms.

Numerous innovations for roof trusses have been provided in the prior art that are described as follows. Even though these innovations may be suitable for the specific individual purposes to which they address, they differ from the present invention as hereinafter contrasted.

In U.S. Pat. No. 3,760,550 titled Collapsible Truss Structure by inventors Mueller et. al. a metal truss structure is disclosed which is prefabricated and capable of being shipped in a collapsed condition, and which can be erected easily at the site into a roof truss capable of spanning all widths common in residential structures and some commercial structures, while remaining a desired and predetermined roof pitch, as for example 4.12. A half truss suitable for panelized construction or for modular construction, and having many of the features of the basic truss structure, is contemplated. This patent utilizes telescoping chord members fabricated of steel. Chord members are pivotally connected by a fastener in horizontally adjacent relation whereby rotational motion occurs on the fastener. The present invention differs from the patent in that: 1) annuli of the disks positioned in the precut substantially circular grooves in the wooden upper and lower chords are integral parts of the hinging mechanism, whereby in contrast, the structural members of the patent are not an integral element of the hinging mechanism; and 2) the patent employs telescoping chord members to achieve the collapse of the truss, including web members, apparently within the width of the overall width of the truss while the present invention achieves the collapse of a half truss with the hinging mechanism alone, part of the roof component extending beyond the width of the housing module, web members being added on the construction site.

This patent differs from the present invention because this patent simply has bolt fasteners and telescoping metal chords whereas the present invention can also utilize wood and plastic composite building components having a rotatable mounted opposed annular disk hinge. In addition, the present invention allows the upper chord to sit atop of the lower chord in assembled relation for added strength.

In U.S. Pat. No. 3,729,877 titled Folding Truss by inventor Raymond L. Hall, a folding truss is disclosed wherein the main beam member in a fully opened condition is arranged in a straight line and in a folded condition is disposed to be compacted to lay in an accordion style. The members providing the straight beam are hinged so as to mate and engage each other in an end-to-end arrangement when the beam is filly opened. A series of connected support arms are pivotally mounted on pins secured to the mid-portions of the main beam members. The connected support arms are pivotally connected at their ends to each other and when the main beam members are in the straight line fully opened condition the support members, which are longer than the main beam members, are disposed in a zigzag pattern which may be about a 30 to 40 degree angle or slope to the axis of the main straight beam.

This patent differs from the present invention because it has multiple hinged upper chord and metal lower chords whereas the present invention has full length lower chord and upper chord beams for additional strength as well as a rotatable mounted annular disk roof hinge. In addition, the present invention allows the upper chord to sit atop the for added strength.

In U.S. Pat. No. 4,438,393 titled Folding Truss by inventor Terry L. Mitchell the specification discloses a structural connector for pivotally connecting two support members to form a folding truss. The support members can be pivoted with respect to the connector between collapsed and extended positions. The connector includes a generally planar body, a locator tab extending from the body and secured between the support members when in their extended position to orient the connector with respect to the connector, and spring clips extending from the body to lock the support members in their extended position. In an alternative embodiment, the connector includes two of the locator tabs to maintain the support members in spaced relation so that a ridge member can be positioned therebetween.

This patent differs from the present invention because it has hinged support members whereas the present invention has full length upper and lower chord support beams for additional strength as well as a rotatable mounted annular disk roof hinge. In addition, the present invention allows the upper chord to sit atop the lower chord for added strength.

In U.S. Pat. No. 4,771,585 Collapsible Truss Unit For Use In Combination With Other Like Units For The Construction Of Frameworks by inventors Junijiro Onods et. al. a collapsible, or deployable, truss unit to be combined with a multiplicity of other similar units for the construction of, typically, medium to large sized frameworks for use in outer space. Generally of boxlike shape when deployed, the truss unit comprises two opposite end truss assemblies of rectangular or quadrilateral shape, and an intermediate truss assembly similar shape interposed therebetween and linked thereto via additional trusses members. Two opposite ones of the four truss members of the intermediate truss assembly have each a movable hinge assembly mounted thereto for longitudinal displacement. Each movable hinge assembly has two diagonal truss members pivoted thereto each at one end, the other ends of the diagonal truss members being pivoted to the respective end truss assemblies. The truss unit can be readily deployed or collapsed into flat form by forcibly moving at least one of the hinge assemblies along the associated intermediate truss member as by a wire and pulley arrangement driven by a reversible drive motor.

This patent differs from the present invention because it is a truss unit consisting of multiple frameworks within whereas the present invention utilizes full length upper chord and lower chord beams for additional strength as well as a rotatable mounted annular disk roof hinge.

In U.S. Pat. No. 5,163,262 Collapsible Structure by Inventor Louis R. Adams a truss structure, which is movable between a collapsed position and a deployed position, has at least one frame section. The frame section has a number of frame units, wherein each frame unit includes three elongated members forming a triangle independent of the triangle formed by the other frame units. A first elongated member of each frame unit is coupled to a first elongated member of another frame unit such that these coupled first elongated members form a polygon. The remaining elongated members of each frame unit are pivotally connected to the first elongated member of of their respective frame unit so as to be pivoted with respect to the first elongated member during movement of the truss structure between the collapsed and deployed positions. A number of foldable batten members are connected at their ends to the frame units to form a second polygon. The foldable batten members fold, approximately at their midpoints, during movement of the truss structure between the collapsed and deployed positions.

This patent differs from the present invention because it is a truss unit consisting of multiple frameworks within whereas the present invention utilizes full length upper chord and lower chord beams for additional strength as well as a rotatable mounted annular disk roof hinge.

In U.S. Pat. No. 5,228,258 Collapsible Truss Structure by Inventor Oneida et. al. a collapsible structure having a shape of a rectangular parallelepiped when expanded is an open truss framework made up of skeletal members pin jointed together by joint connectors to form sixteen rectangular bays, four of which have diagonal braces, and support panels for covering one face of the structure. The joint connectors permit the structure to be folded by power means in two directions into a compact storage and for transportation with the panels assembled therewith, while elastically biasing means automatically unfold the structure into its expanded state. Planner, single curvature, and double curvature panels can thus be supported. This structure can be optionally assembled with other structures to form larger structural assemblies.

This patent differs from the present invention because the patent is a truss unit consisting of multiple frameworks within whereas the present invention utilizes full length upper chord and lower chord beams for additional strength as well as a rotatable mounted annular disk roof hinge.

In U.S. Pat. No. 2,524,652 titled Fastening Member by Charles J. Dalley is disclosed a fastening member in the nature of nut locks. This patent is a connector whose object is to restrict movement by means of frictional engagement "where all parts are held stationary not as hinge joints", whereas the present invention allows rotational motion for the purpose of collapsing the roof component. The object of the annulus of the patent acts to deform the opening so as to frictionally restrict rotative motion. The present invention utilizes annular disks for the object of facilitating rotative motion rather than restricting motion. Numerous innovations for roof trusses utilizing roof hinges have been provided in the prior art that are adapted to be used. Even though these innovations may be suitable for the specific individual purposes to which they address, they would not be suitable for the purposes of the present invention as heretofore described.

SUMMARY OF THE INVENTION

The present invention, roof trusses utilizing annular disk roof hinges, comprises two oppositely facing metal disks having rigid annuli at their respective peripheries, installed as a hinge between an upper chord and a lower chord at their outer distal ends. Then when the annular disk roof hinges are pivotally secured in precut circular grooves in lower chords and upper chords of a modular home, they permit the roof to lay flat for transportation. Upon installation of the modular home on the job site, the roof is extended to a conventional roof pitch, generally 4 feet by 12 feet or more. The roof component (truss or simple rafter) when fully retracted, has a vertical dimension of approximately 15 inches or less, thereby allowing the housing module, together with its transport trailer, to maintain a height which is below the maximum allowable interstate road height restriction being most commonly 13 feet, 6 inches. In addition, by reducing the vertical dimension to a minimum, the present invention allows for a full eight-foot interior ceiling height in the modular home in contrast to a more common 7 feet, 6 inches ceiling height found in most modular homes. The establishment of a full 8 foot ceiling height allows the builder to utilize the most commonly manufactured building products such as studs and sheetrock which typically are mass produced in 8 foot lengths thereby reducing the cost of construction and minimizing wasted time and cutting the building products to fit 7 feet 6 inches.

The present invention, roof trusses utilizing annular disk roof hinges, allows a conventional roof pitch and interior ceiling height, gives modular homes a more conventional appearance and allows them to compete in the marketplace more effectively with conventionally built homes.

The collapsible roof truss of the present invention employs a first and a second rigid metal disks, each disk having an annulus formed its respective periphery, which disks when applied to both sides of wooden structural members consisting of an upper chord and a lower chord, the lower chord having a bevel whose angle is equal to the desired roof pitch, in which structural members grooves having been precut on both sides of each structural member to a depth equal to the height of the annuli, the grooves being in the shape of a semi-circle on the upper chord and the grooves on the lower chord being in the shape of an arc, the arc corresponding to an obtuse angle formed by the bevel of the lower chord. The radii of the circular-shaped grooves are equal to the radii of the annuli. When the upper and lower chord are disposed in assembled vertical planar relation, the grooves form a nearly complete circle. The two disks are placed on opposite sides of the structural members and the respective annuli are disposed in the correspondingly cut grooves in the wooden structural members. A fastener is passed through an opening in the center of each disk and through notches formed in the center of the circular-shaped grooves of the respective structural members to receive the fastener. Rotative hinging motion occurs between the annuli and the corresponding grooves formed in the upper chord when the roof component is raised. The hinge point of the truss members thus joined is at the vertex of the angle formed by the upper chord and the lower chord in their assembled, extended relation, the hinge point thereby being located at the top of the lower chord and allowing a minimum height of the roof component and thereby reducing the overall height of a housing module and its transport vehicle to appropriate highway limits.

A major consideration in the present invention of the hinge design is that it is intended to pivot only once during its useful life. Therefore, in contrast to conventional hinges commonly available, wear and tear on the soft wood fibers of the framing members are inconsequential and irrelevant, In addition, the present invention, in contrast to the prior art, allows the upper chord and the lower chord to be aligned on top of each other in contrast to the prior art allows the upper chord aligned on top of each other rather than side by side thereby increasing the inherent weight that the resulting roof may bear.

With the present invention, the annuli oppositely facing each other, two circular plates secure the upper chord and the lower chord by the positioning of the annuli in the grooves of each set of upper chord and lower chord. The fastener is inserted through the plates and in the hole drilled and/or notch formed at a distal end of the upper and lower chord at the exact pivot point. The fastener is secured tightly. With this arrangement, the roof consisting of multiple roof trusses and/or singular roof trusses lay flat for over-the road shipment at a minimum overall height. Upon arrival at the job site, the roof is raised to the specified pitch, typically 4 feet by 12 feet or 6 feet by 12 feet for single-story homes and to a 10 feet by 12 feet or 12 feet by 12 feet pitch for a one and one-half story home. Structural members (king posts) to support the roof component are installed when the roof is elevated. The king posts may be pivotally mounted on either the upper chord or the lower chord during transportation and thereafter fastened to the other during construction. In addition, the middle post and the support may also be pivotally mounted on either the upper chord or the lower chord during transportation and hereafter fastened at the other end during construction. Upon extension of the roof component, the upper chords are secured to the frame of the home with metal ties such as hurricane anchors. The two housing modules are joined and secured in a conventional manner to complete the structure.

The roof framing may be either a single rafter system with 2 inch by 6 inch or 2 inch by 8 inch framing members (determined by local code for snow loads) or a truss system whose web members are installed on site.

Even though the hinge may bear great weight and resist defastening, the hinge is not intended to be relied upon for any structural purpose. Its preferred purpose is to facile transportation.

It is a feature hereof, that in the foregoing described collapsible truss, the grooved structural members together with the annuli formed on the disks are integrally related to form the hinging mechanism.

The advantages of the present invention are:

(1) it allows the reduction of the overall height of the housing module and transport trailer so as to conform to highway height limits.

(2) it allows for a standard 8 foot interior ceiling height, giving the interior of the home a spacious appearance, thereby improving its customer appeal and reducing overall cost of construction. It reduces waste by fully utilizing common dimensions of building components such as studs and gypsum board which are designed for homes with 8-foot ceilings;

(3) it allows for a conventional roof pitch, adding to the exterior aesthetics of the home;

(4) it is structurally superior to the segmented, hinged roof systems currently employed by most modular housing manufacturers; and (5) it is a relatively inexpensive system in both materials and labor costs, The types of problems encountered in the prior art are clearly discussed in great detail in the Background Of The Invention.

Due to the escalating cost of construction, innovations within the prior art are rapidly being exploited as previously discussed in great detail in the Background Of The Invention.

The present invention went contrary to the teaching of the art which utilized segmented upper chords and/or lower chords and did not allow for the upper chords and lower chords to be aligned with one another during construction thereby resulting in greater inherent overall strength of the roof trusses.

The present invention solved a long felt need to minimize time and cost of construction of roof trusses as well as facilitate transportation. In addition, the present invention allows the use of 8 foot ceiling heights.

The present invention produced unexpected results namely: increase inherent overall strength of the roof trusses.

The novel features which are considered characteristic for the invention are set forth in the appended claim. The invention itself, however, both as to its construction and its method of operation with additional objects and advantages thereof, will be best understood from the following description of the specific embodiments when read and understood in connection with the accompanying drawing.

DRAWINGS: BRIEF LIST OF REFERENCE NUMERALS UTILIZED IN THE DRAWINGS

1A—upper chord member—1A
1B—lower chord member—1B
1C—king post—1C
1D—bolt securing segmented upper chord members—1D
1E—bolt securing hinged upper chord and king post—1E
1F—nails—1F
10—opposed flange roof hinge—10
12—disk—12
12A—disk top—12A
12B—disk flange—12B
12C—disk opening—12C
13A—second disk top—13A
13B—second disk annulus—13B
13C—opening of second disk—13C
14—disk fastener—14
14A—fastener—14A
14B—nut—14B
16A—upper chord—16A
16AA—upper chord circular groove 16AA
16AB—upper chord notch 16AB
16B—lower chord 16AB
16B—lower chord—16B
16BA—lower chord circular groove—16BA
16BB—lower chord notch—16BB
16C—support—16C
16D—king stud—16D
16E—middle stud—16E
16F—bevel angle—16F

BRIEF DESCRIPTION OF THE PREFERRED EMBODIMENT

FIG. 1A is a side view of the prior art exhibiting a fully constructed roof truss.

FIG. 1B is an enlarged view of the prior art hinge.

FIG. 2 is a side view of the prior art exhibiting a partially collapsed roof truss.

DETAILED DESCRIPTION OF THE PREFERRED EMBODIMENT

Figure 3B:
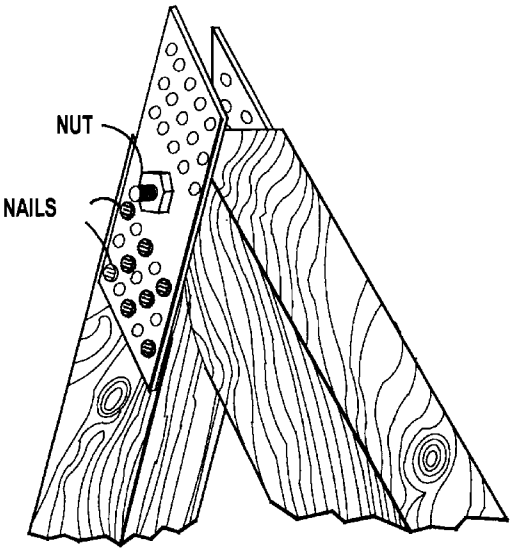
FIG 3B (PRIOR ART)
FIG. 3B is an opposite perspective view of the prior art exhibiting a hinged upper chord in its collapsed position.

Firstly, referring to FIG. 1A which is a side view of the prior art exhibiting a fully constructed roof truss. The prior art roof truss exhibits a segmented upper chord having a hinge which consists of two flat perforated plates FIG. 1B. The segmented upper chord IA is affixed in a straight position. One perforated plate is fastened at one end by nails or screws to a distal end of the outer upper chord segment 1A and by a bolt 1C through a hole at the distal end of the inner upper chord segment IA and then the bolt 1C is fastened to the second perforated plate which is fastened at one end by nails or screws to a distal end of the inner upper chord segment 1A. In addition, the prior art exhibits the middle stud and the support prefabricated in position.

Referring now to FIG. 1B which is an enlarged view of the prior art hinge. From the drawing, it is quite obvious that the strength of the upper chord 1A is compromised and the present invention utilizing a fill length upper chord has increased inherent strength.

Now referring to FIG. 2 which is a side view of the prior art exhibiting a partially collapsed roof truss. The prior art roof truss exhibits a segmented upper chord having a hinge which consists of two flat perforated plates. One perforated plate is fastened at one end by nails or screws to a distal end of the outer upper chord segment and by a bolt through a hole at the distal end of the inner upper chord segment and then the bolt is fastened to the second perforated plate which is fastened at one end by nails or screws to a distal end of the inner upper chord segment. In addition, the prior art exhibits the middle stud and the support perforated in position. Clearly, it is obvious that the roof truss can only collapse to a minimum height of the height of the middle stud.

Figure 3A:
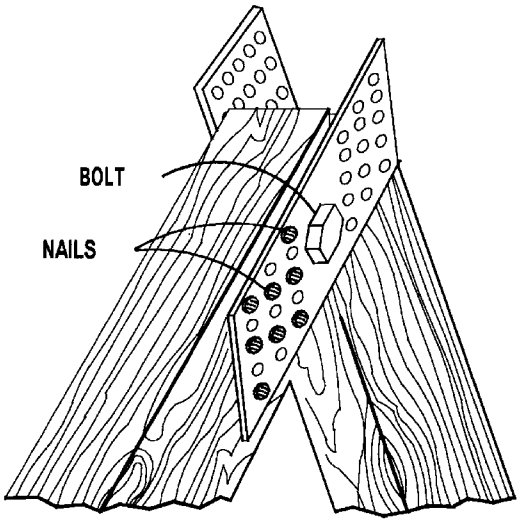
FIG 3A (PRIOR ART)
FIG. 3A is a side perspective view of the prior art exhibiting a hinged upper chord in its collapsed position

Now referring to FIG. 3A and 3B which are side and opposite perspective views, respectively, of the prior art exhibiting a hinged upper chord in its collapsed position The prior art roof truss exhibits a segmented upper chord having a hinge which consists of two flat perforated plates. One perforated plated is fastened at one end by nails or screws to a distal end of the outer rafter segment and by a bolt through a hole at the distal end of the inner upper chord segment and then the bolt is fastened to the second perforated plate which is fastened at one end by nails or screw to a distal end of the inner upper chord segment. It is obvious that a segmented upper chord joined together is weaker in strength than a one piece upper chord as utilized in the present invention.

Figure 4C:
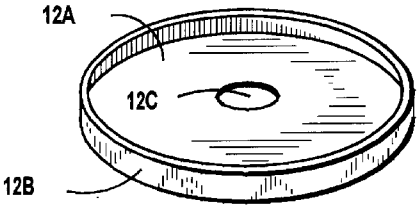
FIG. 4C is a bottom perspective view of an annular disk roof hinge which does not have the fastener in place.
Figure 4B:
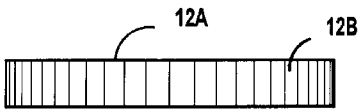
FIG. 4B is a side view of an annular disk roof hinge which does not have the fastener in place.
Figure 4A:
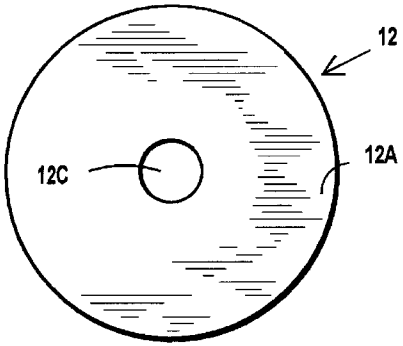
FIG. 4A is a top view of an annular disk roof hinge which does not have the fastener in place.

Referring now to FIG. 4A which is a top view of an annular disk-roof hinge 10 which does not have the fastener 14 in place. The circular shape of the disk 12 having a circular shaped disk top 12A is the preferred embodiment since it allows the annular disk roof hinge 10 to rotate during collapsing and erecting the roof truss.

Referring to FIG. 4B and FIG. 4C which are a side view and bottom perspective view, respectively, of an annular disk roof hinge 10 which does not have the fastener 14A in place. The length of the disk annulus 12B is in the range from 1/10 inches to 2 inches. The preferred length of the disk annulus 12B is in the range from 1/8 inches to 1/2 inches. The disk annulus 12B rest within the upper chord groove 16AA and the lower chord groove 16BA allowing rotation therein.

Figure 5:
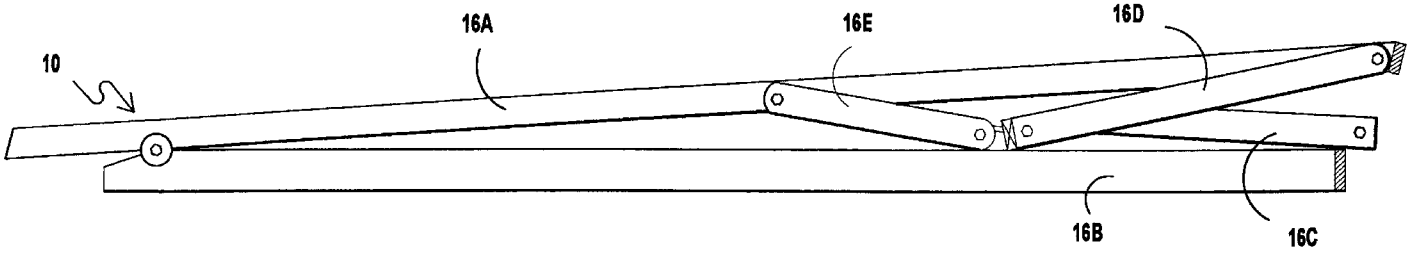
FIG. 5 is a side view of a roof truss exhibiting the annular disk roof hinge in a fully collapsed position.
Figure 6:
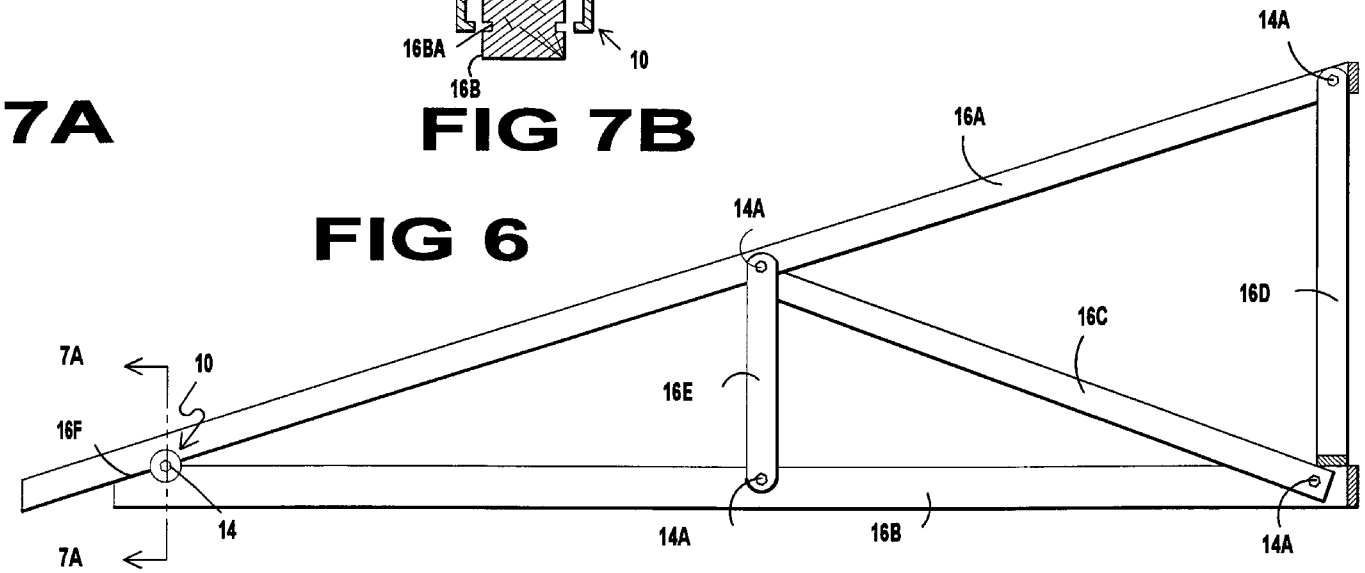
FIG. 6 is a side view of a roof truss exhibiting the annular disk roof hinge in a fully erected position having the king stud, middle stud and support attached in position.

Referring to FIG. 5 which is a side view of a roof truss exhibiting the annular disk roof hinge 10 in a fully collapsed position. The middle stud 16E, the king stud 16D and the support 16C are rotatable affixed on one end by fasteners 14A which are positioned through a hole bored in both adjacent members. When the roof truss exhibiting the annular disk roof hinge 10 is erected into its filly erected position as exhibited FIG. 6, the upper chord 16A and the lower chord 16 rotate oppositely upon the annular disk roof hinge 10 until the king stud 16D is affixed in its fully extended position Notice the lower chord angle 16F which coincides with the angle of the of the pitch of the roof. The lower chord angle 16F allows the upper chord 16A to rest atop of the lower chord 16B in greater inherent strength of the roof truss. After the king stud 16D is affixed in position, the middle stud 16E and the support 16C are affixed in position forming the roof buss.

Figure 7B:
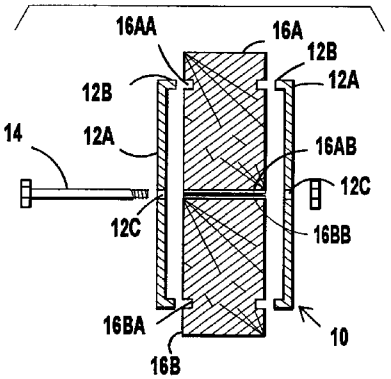
FIG. 7B is a cross-sectional view of a roof truss exhibiting the annular disk roof hinge being connected to the upper chord and the lower chord further exhibiting the disk annuli correspondently entering the upper chord circular groove and the upper chord circular groove.
Figure 7A:
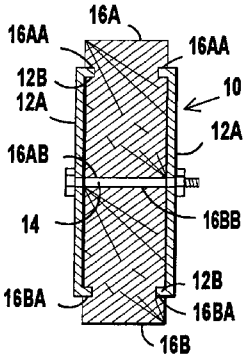
FIG. 7A is a cross-sectional view of a roof truss exhibiting the opposed flange roof hinge connected to the upper chord and lower chord further exhibiting the disk annuli correspondently entering the upper chord groove and the lower chord circular groove.

Lastly referring to FIG. 7A and FIG. 7B which are cross-sectional views of a roof truss exhibiting the annular disk roof hinge 10 connected to the upper chord and the lower chord in an assembled and on-assembled position, respectively. The upper chord 16A has a upper chord notch 16AB and the lower chord 16B has a corresponding oppositely facing lower chord notch 16BB which form a bore therebetween when both are assembled together.

During assembly, a first annular disk plate 12A is positioned on the fastener 14 with the disk annulus 12B facing toward the upper chord 16A and the lower chord 16B which have been previously placed atop one another. The fastener 14A rests in the bore formed by the opposing upper chord notch 16AA and the lower chord notch 16BB and thereafter a second disk 13A is positioned on the fastener 14A with the disk annulus 13B facing toward the upper chord 16A and the lower chord 16B. The fastener 14A then is secured by a nut 14B (if the fastener is a bolt) and the nut is tightened so that the disk annuli 12B and 13B are positioned within the corresponding upper chord groove 16AA and the lower chord groove 16BA. The proper amount of tightening is crucial since the upper chord 16A and the lower chord 16B must be able to rotate oppositely from each other during assembly. After assembly occurs, the fastener is tightened in position such than further rotation is restricted.

It will be understood that each of the elements describe above, or two or more together, may also find a useful application in other types of constructions differing from the type described above.

Without further analysis, the foregoing will so fully reveal the gist of the present invention that others can, by applying current knowledge, readily adapt it for various application without omitting features, that from the standpoint of prior art, fairy constitute essential characteristics of the generic or specific aspects of this invention.

What is claimed as new and desired to be protected by letters patent is set forth in the appended claim:

1. A collapsible roof truss comprising:

two hinged elongated wooden structural members, comprising of an upper chord and a lower chord, said structural members joined at an angle, said lower chord having a bevel at one end thereof, each said structural member having precut grooves located on two sides of said chords, each said groove of said upper chord being in the form of a semicircle, each said groove of said lower chord being in the form of an arc corresponding to an obtuse angle formed by the bevel of the lower chord;

said grooves on each side of said structural members forming a nearly complete circle;

a notch on each structural member located at the vertex of the angle formed by said structural members;

first and second metal disks, each of said disks having a diameter corresponding to the diameter of the nearly complete circles, each of said disks having a rigid annulus formed therefrom at its respective periphery, each of said disks having an opening therethrough in its respective center for pivotally connecting said first and second disks in assembled relation to join the structural members;

said grooves of said structural members having a width sufficient to accept the respective annuli of said disks;

wherein said annulus of said first disk is disposed in said grooves on one side of said upper and said lower chords and said annulus of said second disk is disposed in said grooves of the other side of said upper and lower chords and means passing through both said disk openings and each said notch for pivotally connecting said disks to one another and for drawing said annuli into said grooves, the pivotal axis being located at the vertex of the angle formed by said structural members and allowing for rotational movement of said annuli within said grooves and of said structural members to a desired roof pitch.

* * * * *